United States Patent [19]

Ferreira-Godinho

[11] 4,243,221

[45] Jan. 6, 1981

[54] TRAINING DEVICE FOR PRACTICING THE SERVICE IN TENNIS

[76] Inventor: Manuel Ferreira-Godinho, Sedanstrasse 5, D 3250 Hameln 1, Fed. Rep. of Germany

[21] Appl. No.: 9,851

[22] Filed: Feb. 7, 1979

Related U.S. Application Data

[63] Continuation of Ser. No. 826,922, Aug. 22, 1977, abandoned.

[30] Foreign Application Priority Data

Aug. 24, 1976 [DE] Fed. Rep. of Germany ..... 2638037

[51] Int. Cl.[3] ..... A63B 29/38

[52] U.S. Cl. ..... 273/29 A; 273/29 BD; 273/29 BG

[58] Field of Search ..... 273/29 A, 29 BB, 29 BC, 273/29 BD, 29 BE, 29 BF, 29 BG, 26 R, 26 A, 26 D, 179 R, 181 F, 181 K, 182 R, 182 A, 103, 95 H, 411

[56] References Cited

U.S. PATENT DOCUMENTS

| | | | |
|---|---|---|---|
| 1,371,867 | 3/1921 | Dean | 273/103 |
| 1,373,247 | 3/1921 | Jensen | 273/103 |
| 2,159,633 | 5/1939 | Petersen | 273/29 BC |
| 2,805,070 | 9/1957 | Waters | 273/181 BF |
| 2,899,208 | 8/1959 | Wallsteiner | 273/182 R |
| 3,215,432 | 11/1965 | Lee et al. | 273/29 A |
| 3,563,544 | 2/1971 | Hedrick | 273/29 A |
| 3,918,711 | 11/1975 | Zak | 273/29 A |
| 3,966,205 | 6/1976 | Schain | 273/29 A |
| 4,122,451 | 10/1978 | Senoh | 273/29 BF |
| 4,135,716 | 1/1979 | Ginsburg | 273/29 BC |

FOREIGN PATENT DOCUMENTS

| | | | |
|---|---|---|---|
| 12186 | of 1887 | United Kingdom | 273/29 BG |
| 16336 | of 1904 | United Kingdom | 273/29 BB |

*Primary Examiner*—Richard C. Pinkham
*Assistant Examiner*—T. Brown
*Attorney, Agent, or Firm*—Price, Heneveld, Huizenga & Cooper

[57] ABSTRACT

A device is disclosed for practicing the serve in tennis which provides a second or practice net. The practice net is erected above and in the same general vertical plane as the conventional net used for playing tennis where it will intercept balls hit over the conventional net. In addition, a recovery net is provided adjacent the bottom edge of the conventional net and is shaped to bias the intercepted balls toward the center of the conventional net and to return them toward the player. The conventional and practice nets may be separate or joined. Various powered or manual means are disclosed for erecting and tensioning the practice net.

11 Claims, 2 Drawing Figures b
d
i
a
30
c
e
6
h
f
j
g

TRAINING DEVICE FOR PRACTICING THE SERVICE IN TENNIS

Figure 1:
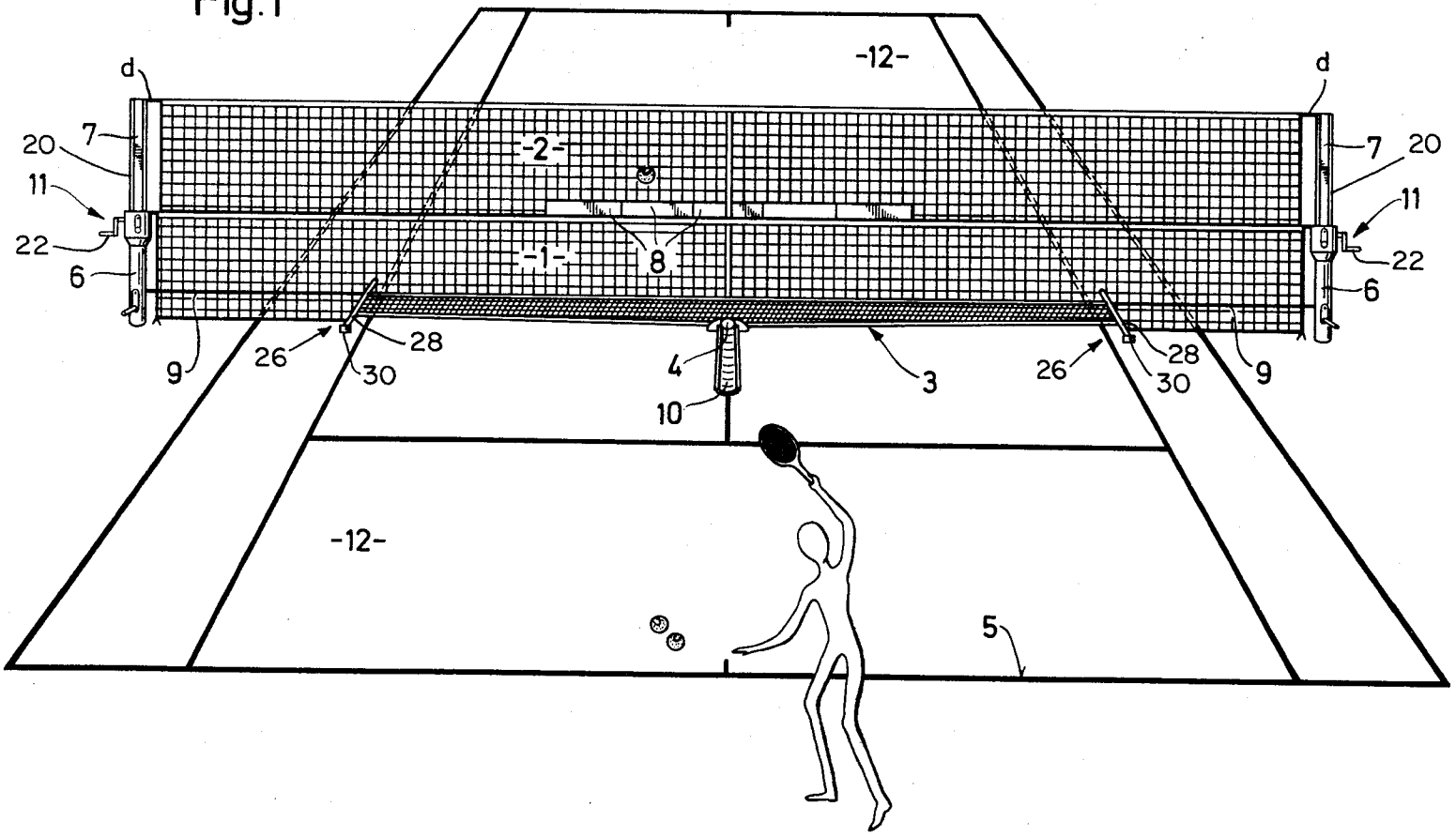

This is a continuation of application Ser. No. 826,922, filed Aug. 22, 1977 (abandoned).

The invention relates to a training device for practicing the service in tennis. The service in tennis represents an important shot, since the game is begun with it and since it is the only shot which cannot be influenced by the opponent. Nevertheless one can make the observation on the tennis courts that only extremely few players master the service, even if they master the remaining shots quite well. The reason herefor might be the fact that the practicing of the service is felt to be frustrating.

The advice is still valid for practicing the service, said advice being found in most books about tennis, that one should play about 60 to 100 balls as services during each training, but this is mostly only done by keen players. There are several reasons for this behaviour, only few players have e.g. such a large number of balls and the tennis clubs rarely make them available. It is futhermore a nuisance, if one serviced such a number of balls to go to the other side of the tennis court and to collect the balls again.

In addition thereto quite a number of tennis courts, in particular indoor tennis courts is not provided with a fence so that one cannot practice the service without bombarding the players on the adjacent courts with one's balls.

It is true that there is a so-called training wall on some tennis courts, which is arranged vertically on a training ground and lets the tennis balls served against the training wall rebound, however such a training wall is not suited for practicing the service. Due to their kinetic energy the balls jump back quickly from the training wall and due to the relationship angle of incidence =angle of reflection they do not return to the player in most cases so that also in case of the use of such a training wall similar disadvantages as described above occur.

It is the object of the invention to indicate a training device which allows the practicing of the service in tennis in a simple manner and with little material expenditure.

The solution according to the invention consist in designing a training device for practicing the service in tennis in such a manner that a second training net rising at least partly above the play net and having approximately the same dimensions as the play net is arranged above the normal play net of a tennis court and that at least a further smaller net is erected before the play net as recovery net which catches the balls served into the play net and the training net and lets them roll out in the direction of the base line of the playing field through a ball outlet.

The training net of the training device according to the invention can be arranged vertically adjustable and attached to the net post of the play net.

In a further development of the invention the training net can be slipped on the net posts of the play net with its side posts.

In another embodiment of the training device according to the invention the training net is adjustable with a device being actuable manually or electromechanically, the tension of the training net being suitably adjustable.

In a further development of the invention the training net is provided with detachable target markings for practicing various service techniques.

In a further embodiment of the training device according to the invention the training net is designed in one piece with the play net.

It is especially advantageous, if the recovery net is arranged with adjustable inclination as against the play net above the play ground, the recovery net being suitably designed in a fine-meshed manner and having a slight adjustable slope in direction of its ball outlet.

In a further embodiment of the training device according to the invention the recovery net is provided with a frame being attachable to one of the net posts of the play net. It is especially advantageous if the ball outlet of the recovery net has an outlet tube being arranged with a slight slope in direction of the base line.

In a further development of the training device according to the invention a recovery net is arranged on each of the two sides of the play net.

In the following the training device according to the invention is explained in detail by means of examples of embodiment and by means of the enclosed drawings.

Figure 2:
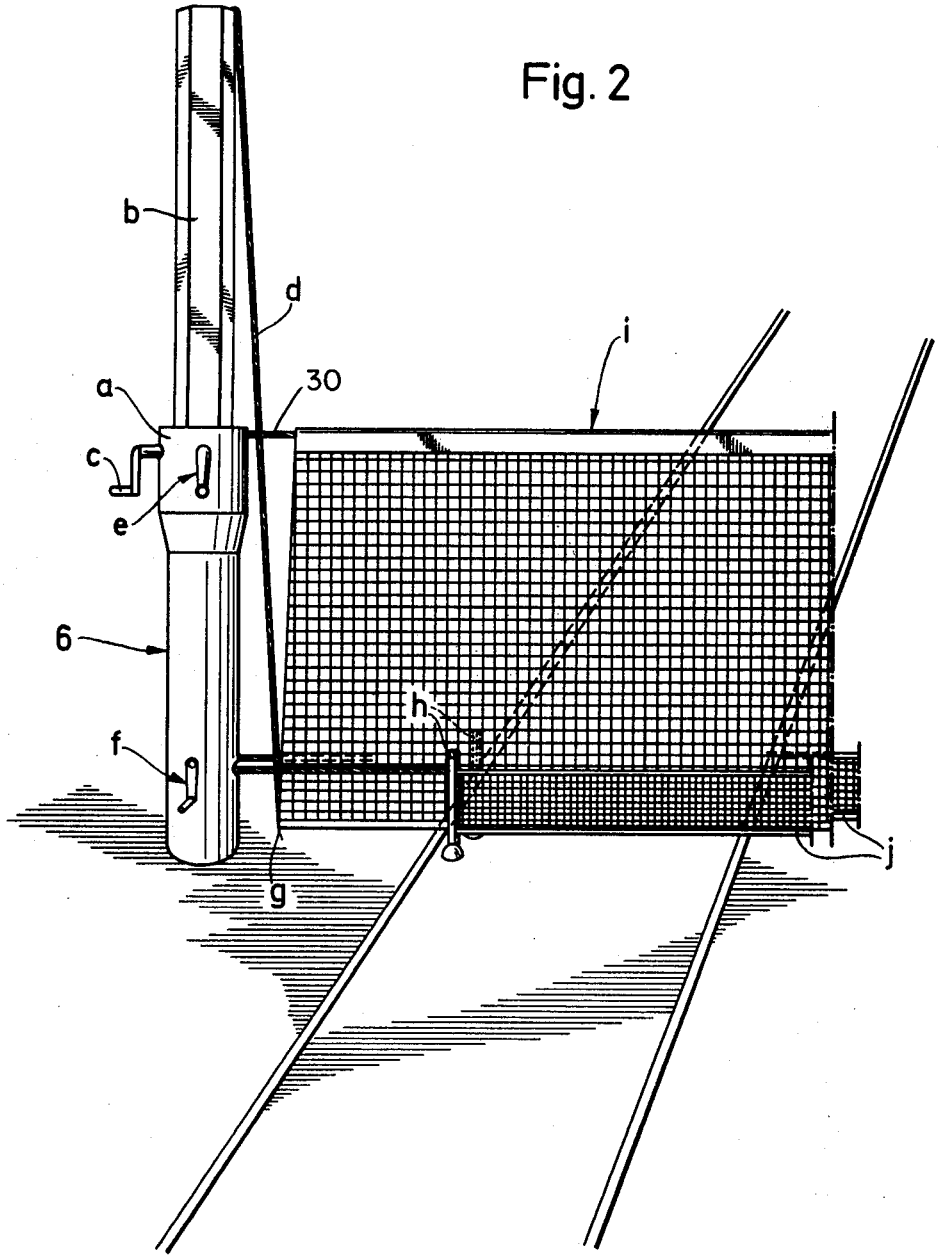

FIG. 1 shows a schematic representation of the training device according to the invention and FIG. 2 a detail of a further embodiment.

Apart from the normal play net 1 of a tennis court 12 the training device according to FIG. 1 has substantially a training net 2 as well as a recovery net 3. The training net 2 has approximately the same dimensions as the play net 1 and is arranged above the play net 1, above which it rises at least partly, the training net 2 being provided between the two side posts 7 being suitably attached to the net posts 6 of the play net 1 and being vertically adjustable. Ropes d attached between net 2 and posts 7 are used to raise the net 2 above the play net 1. Such an attachment of the training net 2 can be carried out by various methods. As an example by means of straps being attached to the side posts 7, which are provided with a joint and a wing screw arrangement, which make a detachable attachment of the side posts 7 to the net post 6 of the play net 1 possible. This method is not illustrated in the drawings.

Another manner of attachment, which is not illustrated, of the training net 2 consist in that the net posts 6 of the play net 1, which are usually constructed in a hollow manner, are provided with borings into which the side posts 7 of the training net 2 are inserted, there being the possibility that the training net 2 being possibly detachably attached to its side posts 7 can be strung up subsequently. The respective side posts 7 of the training net 2 are suitably provided at their lower side with fixed or adjustable stops so that the height of the training net 2 above the play net 1 can be adjusted by means of these stops. It can be advantageous to design the side posts 7 of the training net 2 in an angular, e.g. sexangular manner and to provide the net posts 6 with complementary borings for the angular side posts 7 so that the same can be inserted untwistably into the net posts 6. With such an arrangement with angular side posts 7 it is readily possible to regulate the tension of a training net 2 being fixedly attached to the side posts 7 by changing the angular position of the respective side post in the net post. In other words, the ropes d could be wrapped around the side posts by rotating the posts which would then be reinserted into the net posts.

In the embodiment of the device as illustrated in FIG. 1 of the training device the side posts 7 are equipped with toothed racks or the like along their lateral edge 20 which can be extended with a device 11 in the form of a toothed gearing or the like. In FIG. 1, only handle 22 of device 11 is shown. The toothed gearing is within hollow post 6 and meshes with the geared or toothed rack along edge 20 of post 7. Device 11 raises the side posts and hence the practice net. The actuation of this device can be effected either manually with a crank, as shown in FIG. 1, or electromechanically so that the training net stretched between the side posts 7 can be adjusted to an optional height. In such an embodiment a corresponding gearing or an electromechanical or hydraulic device must however be provided at the two net posts 6 for the retraction and extension of the training net 2, which are individually actuable or can be jointly driven via rods arranged below the play net. If an electromechanical device for actuating the side posts 7 at the net posts 6 is concerned, a corresponding electrical connection must of course be ensured.

The tension of the training net 2 is suitably adjustable in accordance with the respective requirements (that is, raised above net 1) and can e.g. be effected with a tackle or rope d attached to one of the side posts 7 (as seen in FIG. 1) or by rotating the side posts 7 about the respective axis, if side posts with angular cross-section are used. So that various service techniques can be used, e.g. with or without twist, the training net 2 is suitably provided with detachable target markings 8, for which e.g. coloured plastic films are suited which e.g. make a cracking noise, if they are hit by a ball (FIG.1). A training net 2 can also be used which is designed in one piece with the play net 1. For this purpose a net having approximately twice the size of a play net 1 is provided which is attached to the net posts 6 in a customary manner forming a double curtain. Whereas the one side of this net hangs as play net 1 between its net posts 6, the other side of the net is attached to the side posts 7 and can be arranged in the manner described above forming a training net 2 above the play net 1.

Before the play net 1 at least one smaller net is erected as recovery net 3 and arranged in such a manner that it catches the balls served into the play net 1 and the training net 2, said balls rolling out subsequently through a ball outlet 4 of the recovery net 3 in the direction of the base line 5 of the playing field 12.

For this purpose the recovery net 3 is arranged with adjustable inclination by stands 26 as against the play net 1 and approximately in parallel to the base line 5 and thus to the centre line of the playing field 12 above the playing field. Stands 26 each include an angularly adjustable rod 28 carried by a base plate 30. Base plate 30 resets on the court surface. So that the caught balls get to the ball outlet 4 without difficulties, the recovery net 3 is designed in a fine-meshed manner or in the shape of a canvas and provided with a slight adjustable slope in the direction of its center and hence the ball outlet 4. As regards its dimensions the recovery net 3 can be smaller than the play net 1 and the training net 2 and also somewhat shorter than the same, however a sufficient length must be present so that a ball served into the play net 1 or the training net 2 can be actually caught by the recovery net 3.

The recovery net 3 can either be erected before the play net 1 with a stand 26 of its own, as shown in FIG. 1 or it can be provided with a frame 9, with which the recovery net 3 can be attached to the net post 6 of the play net 1. The attachment of the frame 9 of the recovery net 3 to the net post 6 can e.g. be carried out using straps and wing screw arrangements or by means of borings provided transversely in the net posts 6, into which the frame 9 is inserted in a simple manner. These methods are not illustrated.

The ball outlet 4 of the recovery net 3 is provided with an outlet tube or an outlet cylinder 10, which is arranged with a slight slope in the direction of the base line 5 of the playing field 12. In this manner a ball served into the play net 1 or the training net 2 falls first of all into the recovery net 3, rolls in the direction of the outlet 4 and through the outlet tube 10 in the direction of the base line 5 of the playing field 10. Therefore it is readily possible to practice the service in tennis with a small number of balls or even with a single ball when using the above described training device, since the balls roll automatically back to the player.

It is of course readily possible that two players practice at the same time with the above described training device from opposite sides of the play net 1 or the training net 2. For this purpose a second recovery net 3 must be erected on the other side of the play net 1 so that the balls served into the nets from the respective sides roll back to the correct side. Thus two players can practice their service at the same time in a simple manner without disturbing each other.

The training net 2 and that or the recovery net(s) (3) can in each case be dismounted or retracted within a short period of time so that the playing field is again available for the normal games.

A further embodiment of the training device according to the invention is schematically suggested in FIG. 2. In this embodiment an attachment a, which is generally cylindrical, is slipped on the normal net posts 6 present on each tennis court, the form of the attachment a being selected in such a manner that the same rests as closely against the upper part of the net post 6 as possible, but can also be removed, if necessary. The attachment a is furthermore provided with a side post b being substantially vertically upright which can be inserted into the attachment a or designed in one piece with the attachment a. The side post b can e.g. have a sexangular cross-section so that it can be installed in the attachment a in an untwistable manner. Once post b is slipped or positioned into attachment member a, it will not rotate.

The training net i is attached to the net post 6 or the attachment a with one of its longitudinal sides, whereas its opposite longitudinal side is provided with a rope d approximately at g. The rope d runs along in the interior of the side post b and can e.g. be wound up in the interior of the elements a and b with a crank. When doing this the training net i is drawn up and stretched. The stretching of the training net i can be furthermore carried out a stretching means e at its lower side. Means e includes a rope 30 attached to the net and which is wrapped around the end of the crank which is within attachment a. The training net i can either be designed in one piece with the play net as shown in FIG. 2 or as individual training net in this embodiment. In each case it is advisable to provide the winding up means provided with a crank c or the like with a stopping means so that the stretched training net i can be set in each optional position.

A stretching device f is furthermore provided at the side post 6, with which the recovery net i can be stretched and adjusted. A kind of support h is suitably attached to the ends of the recovery net j, with which the recovery net j can be brought on the one hand into the normal substantially horizontal catching position and on the other hand into a substantially vertical retracted position, the recovery net j extending directly before and in parallel to the normal play net in the last-mentioned position. The support h is connected to the net posts 6 with rods or the like in the above described manner. Corresponding complementary means must of course also be provided at the second net post 6 of the tennis court.

The above described training device results thus in a series of advantages:

Very few balls are required for practicing the service;

The balls must not be picked up after having practiced the service so that the players can dedicate their time completely to the training itself;

Two players can practice the service at the same time without disturbing each other or hindering adjacent tennis courts;

The training device can be mounted and dismounted in a simple manner and can be used on every normal tennis court. The device and be retracted or dismounted with effortless ease so that the tennis court is available for normal use.

All features described above are of importance for the training device according to the invention.

What we claim is:

1. A device for practicing the serve in tennis and for playing tennis, said device comprising:

a pair of spaced, vertical net posts;

a tennis net extending between said net posts and positioned for playing tennis in a normal fashion;

a pair of side posts, one side post being attached to and extending above each of said net posts;

means interconnecting said side posts to said net posts for raising and lowering said side posts relative to said net posts;

a service practice net having an upper longitudinal edge and a lower longitudinal edge, said service practice net being secured to the upper edge of said tennis net along its lower longitudinal edge; and raising means supported on said side posts and operatively connected to said service practice net for raising said practice net from a first position at which tennis may be played with said tennis net to a second position extending between said side posts at which said service practice net extends above and in the same general plane as said tennis net and is positioned for practice of the serve.

2. A device as defined by claim 1 further including recovery means positioned between said posts, along and adjacent lower edge of said tennis net for recovering a tennis ball hit into said service practice net and directing the ball back to a player.

3. A device as defined by claim 2 further including another recovery means positioned between said posts, along and adjacent the lower edge of said tennis net on a side opposite said recovery means, said another recovery means and said recovery means each comprising:

means operatively connected to said recovery net for supporting said recovery net and for shifting said recovery net from a stored generally vertical position to an operative position angled outwardly from the tennis net, said recovery net, when in said operative position, having a small inclination towards its center to bias tennis balls to the center thereof; and a tubular trough mounted to the center of and inclined away from the recovery net for discharging balls away from the tennis net towards a player.

4. A device as defined by claim 3 wherein said side posts are removably supported on and detachable from said net posts.

5. A device as defined by claim 4 wherein said side posts have an angular shape in cross section and said net posts have a complementary bore for receiving said side posts.

6. A device as defined by claim 3 further including target markings detachably carried by said service practice net.

7. A device attachable to conventional net posts between which a tennis net extends for practicing the serve in tennis and permitting the normal play of tennis over said tennis net alone, said device comprising:

a pair of side posts, each side post having an attachment portion configured to be positioned on a tennis net posts so that said side posts are adapted to extend vertically from and above the net posts;

a service practice net having means for attaching one of its longitudinal edges to the upper edge of a tennis net;

means carried by said side posts for raising said service practice net from a lowered position to a raised operating position extending between the side posts and for tensioning said practice net, said means comprising a crank mounted on one of said side posts and a flexible member extending through one of said side posts and having one end secured to said crank and the other end connected to other longitudinal edge of said service practice net; and tennis ball recovery means positionable adjacent a lower edge of a tennis net for recovering and returning a tennis ball hit to a player and into the service practice net from either side thereof.

8. A device as defined by claim 7 further including:

means carried by said side posts for raising and lowering said side posts relative to said attachment portion and hence relative to the net posts to adjust the height of the side posts and the service practice net.

9. A device as defined by claim 8 wherein said tennis ball recovery means comprises:

a first recovery net;

means for securing said first recovery net to the net posts at and along one side of the tennis net;

a second recovery net;

means for securing said second recovery net to the net posts at and along the other side of the tennis net;

a first tubular trough mounted to the center of and inclined away from the first recovery net for directing balls recovered in said first recovery net to a player; and a second tubular trough mounted to the center of and inclined away from the second recovery net for directing balls recovered in said second recovery net to another player.

10. A device as defined by claim 9 further including plastic target markings detachably carried on said service practice net.

11. A device as defined by claim 10 wherein said side posts each have an angular shape in cross section.

* * * * *

UNITED STATES PATENT AND TRADEMARK OFFICE

CERTIFICATE OF CORRECTION

PATENT NO. : 4,243,221

DATED : January 6, 1981

INVENTOR(S) : Manuel Ferreira-Godinho

It is certified that error appears in the above—identified patent and that said Letters Patent is hereby corrected as shown below:

Column 2, line 39:

After "straps" insert --or ropes d (Fig. 1)--;

Column 3, line 52:

"resets" should be --rests--.

Signed and Sealed this

*Twenty-fifth* Day of *August 1981*

[SEAL]

*Attest:*

GERALD J. MOSSINGHOFF

*Attesting Officer*

*Commissioner of Patents and Trademarks*